US006023902A

United States Patent [19]

So

[11] Patent Number: 6,023,902

[45] Date of Patent: Feb. 15, 2000

[54] FRAME STRUCTURE AND METHOD OF CONSTRUCTION BY USING THE SAME

[76] Inventor: Kwang-min So, 63-5 Mansu-4-dong, Namdong-gu, Incheon Kwangyok-shi, Rep. of Korea, 405-244

[21] Appl. No.: 08/966,653

[22] Filed: Nov. 10, 1997

[30] Foreign Application Priority Data

Nov. 14, 1996 [KR] Rep. of Korea ..... 96 54011

[51] Int. Cl.[7] ..... E04H 12/00

[52] U.S. Cl. ..... 52/649.1; 52/633; 249/214

[58] Field of Search ..... 52/633, 645, 646, 52/647, 648.1, 649.1, 649.2, 649.8, 654.1, 600, 662, 442, 426; 249/214, 41

[56] References Cited

U.S. PATENT DOCUMENTS 4,815,727 3/1989 Kirlbuchi ..... 52/640

4,825,620 5/1989 Johnson ..... 52/646.1

4,901,498 2/1990 Gerwick ..... 52/650

4,999,965 3/1991 Schmidgall ..... 52/684

5,802,780 9/1998 Hammerschlag ..... 52/105

*Primary Examiner*—Beth Aubrey

[57] ABSTRACT

This invention relates to a sectional steel-frame structure and a method of construction using the same in which vertical members, horizontal members and brackets may be assembled to form a lattice, thus keeping the frame structure and performing arrangement construction more rapidly and conveniently. By using the sectional steel-frame structure, it becomes possible to simultaneously perform the construction of insulation boards and interior/exterior materials as well as concrete pouring work so that the construction period and construction expenses such as labor cost, subsidiary materials cost and the like may be considerably reduced.

14 Claims, 6 Drawing Sheets

FRAME STRUCTURE AND METHOD OF CONSTRUCTION BY USING THE SAME

BACKGROUND OF THE INVENTION

This invention relates to a frame structure, preferably a steel frame structure and a method of construction by using the same, in which the frame structure is installed as a framework of buildings in the construction of apartment houses, buildings, factories, and the like, and more specifically, to a sectional steel-frame structure and a method of construction by using the same in which the sectional steel-frame structure may be assembled and constructed rapidly and conveniently. By using the steel-frame structure, it is possible to simultaneously perform construction work of interior/exterior materials and insulation boards and concrete pouring work, so that construction time and construction cost may be reduced considerably.

Generally, when construction of a frame structure for a concrete building is performed, reinforcing rods, section steels, beams, and the like are arranged in perpendicular and horizontal directions for inner and outer walls. Interior/exterior molding plates are installed at both sides of the arranged materials. Fresh concrete is poured in a mold formed as above. After the poured concrete is cured in the molds, reinforcing rods are arranged on the cured concrete. Molding plates are installed on the reinforcing rod. Fresh concrete is poured in the molds to form a slab. When the inner and outer walls and slabs are formed completely, removal work of the mold and construction work of the insulation boards and interior/exterior materials are performed in order.

The conventional construction process will now be explained in more detail. In the construction of a building, after foundation work of the ground, reinforcing rods, section steels, beams, and the like are arranged on certain portions in the perpendicular and horizontal directions and the arranged reinforcing rods are linked each other. Wooden molds are usually installed on the inner and outer sides of the arranged reinforcing rods. The inner and outer molds may be supported by struts set up on respective outer surfaces of the interior/exterior molding plates or interval keeping means.

The conventional steel-frame structure and method of construction by using the same have, however, disadvantages that the struts and the interval keeping means are complicated to use. The struts must be respectively struck with big nails against the molding plates, making the installation and removal of the struts difficult. In addition, the interval keeping means must be fixed between the interior/exterior molds by passing through therebetween, which is time consuming.

Further, the conventional frame structure and method of construction by using the same have further problems that when the interior/exterior molding plates installed as above are removed after the walls and the slabs are completely cured as a concrete body, it takes a very long time to remove the struts, the interval keeping means and the molding plates in order. Labor costs increase greatly in addition to the cost of subsidiary materials such as the molding plates, struts and interval keeping means.

Also, the conventional method of construction has still further problems that construction costs increase considerably due to extensions in construction time and the heavy expense of labor costs, since the construction works of the inner and outer walls, the insulation boards, and the interior/exterior materials are performed not simultaneously but separately in such a manner that the insulation boards are installed inside an outer wall after construction work of the inner and outer walls and slabs, the construction work of the insulation work for installing insulation plates inside the outer walls and piling of bricks, and the interior/exterior materials are performed in order.

SUMMARY OF THE INVENTION

The object of the present invention is to provide a sectional steel-frame structure in which vertical members and horizontal members formed from elongated sections of steel in the shape of a bracket "[" may be assembled as a lattice, thus allowing the construction of buildings more rapidly and conveniently.

Another object of the present invention is to provide a construction method by which it becomes possible to simultaneously perform a plurality of individual works such as casting work of walls, the construction work of the interior/exterior materials and the insulation boards by using the steel-frame structure, thus considerably reducing construction expenses and labor cost.

According to the invention there is provided a mold frame for constructing a structure comprising an inner frame formed of opposingly positioned pairs of substantially vertical members spaced apart by opposingly positioned pairs of spacer members affixed thereto defining an inner channel in the substantially vertical plane; and a plurality of brackets fixed to the inner frame and extending either side of the inner channel for supporting mold plates substantially parallel to and spaced from either side of the inner channel. It will be recognized that the invention can be placed at any other suitable orientation than vertical. It will further be recognized that any other suitable frame material than steel can be used and any other suitable mold material than concrete can be used.

BRIEF DESCRIPTION OF THE DRAWINGS

Embodiments of the invention will now be described by way of example with reference to the accompanying drawing, in which.

DETAILED DESCRIPTION OF THE PREFERRED EMBODIMENTS

Figure 1:
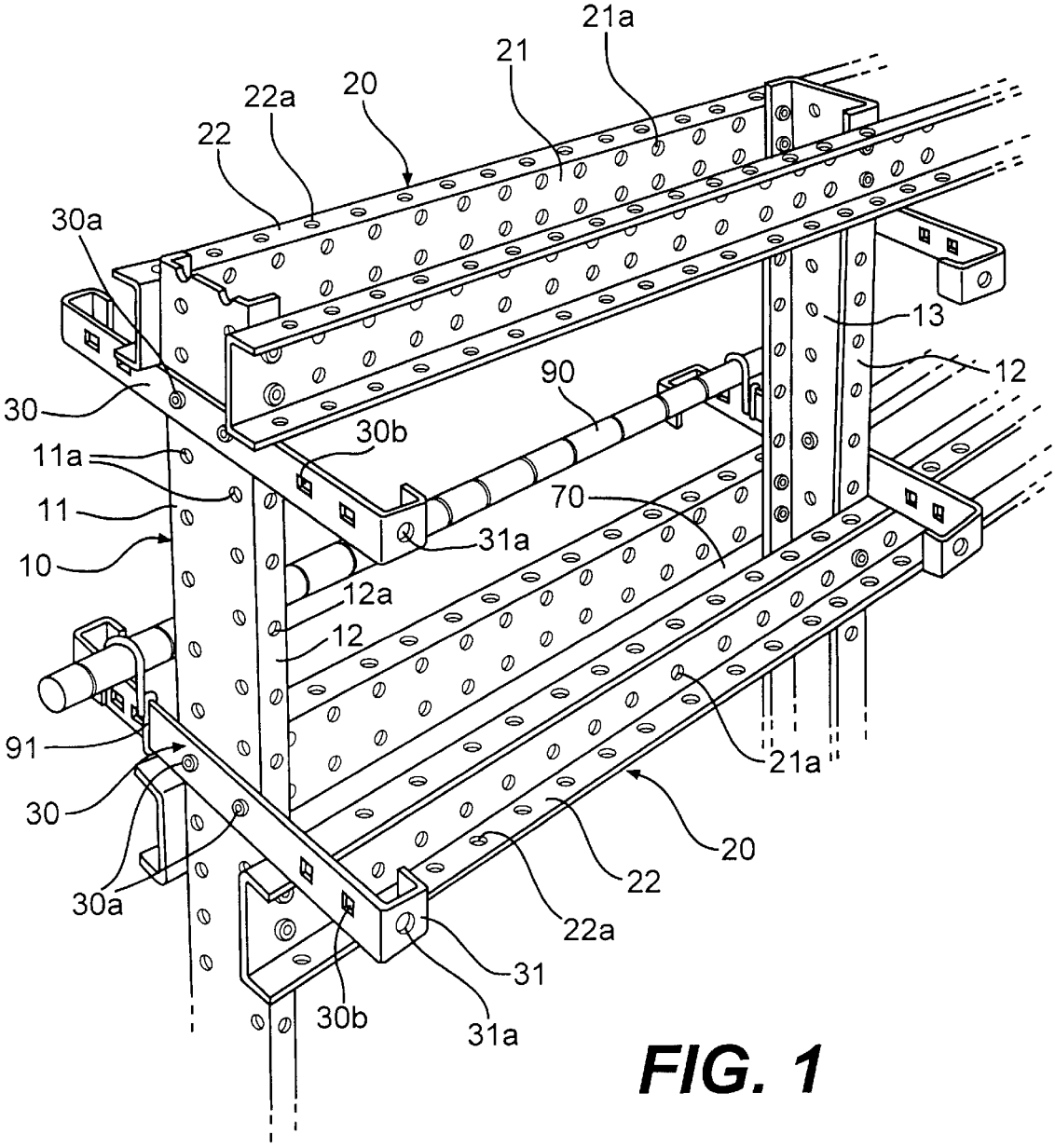
FIG. 1 is a perspective view showing a sectional steel-frame structure according to an embodiment of the present invention.

In FIG. 1, a sectional steel-frame structure according to the present invention has vertical members 10, horizontal members 20 and brackets 30.

The vertical members 10 are section steel materials in the shape of a bracket "[". The vertical members 10 have a number of holes 11*a* perforated on surfaces 11 thereof in two rows at regular intervals in a longitudinal direction and a number of holes 12*a* perforated on two end parts 12 at regular intervals in a longitudinal direction.

The horizontal members 20 are formed from elongated steel sections in the shape of a bracket "[", as are the vertical members 10. The horizontal members 20 have a number of holes 21*a* perforated on surfaces 21 thereof in two rows at regular intervals in a longitudinal direction and a number of holes 22*a* perforated on two end parts 22 at regular intervals in a longitudinal direction.

The brackets 30 shaped in the form of "z,900 " have two tab portions 31, bent perpendicular to the length of the brackets 30, a pair of holes 30*a* in the center thereof to be fixed to the vertical member 10, and a pair of steel wire inserting holes 30*b* between the holes 30*a* and the bent portions or tabs 31 to fix a reinforcing rod 90 by a steel wire 91. Screw holes 31*a* are perforated on the sides 31 of the brackets 30 to fix interior/exterior materials 50.

As shown in FIG. 1, a sectional steel-frame structure according to the present invention is formed as follows.

The vertical members 10 are oppositely set up with a certain interval to face the inner surfaces of each other in order to make an insertion space 70 for inserting an insulation board 80.

The horizontal members 20 are assembled on upper and lower sides 12 of the vertical members 10 to form a lattice by riveting or bolting through the holes 12*a* on the sides 12 of the vertical members 10 and the holes 21*a* on the surfaces 21 of the horizontal members 20 which are faced and coincided at regular intervals.

The brackets 30 are fixed on the vertical members 10 by riveting or bolting through the holes 30*a* of the brackets 30 and the holes 11*a* of the surfaces 11 of the vertical members 10.

According to the present invention, the vertical members 10, the horizontal members 20 and the brackets 30 may be assembled fast to maintain the framework of the steel-frame structure. If necessary, reinforcing rods may be easily fixed on the brackets 30 by steel wire 91 through a pair of steel wire insertion holes 30*b*. An insulation board 80 is inserted in an insertion groove 70 formed between the vertical members 10 and the horizontal members 20. In the manner as above, operation efficiency may be improved, thus reducing the construction period and the construction expenses by reducing the consumption of manpower.

A construction method by using the sectional steel-frame structure according to the present invention will now be explained.

Figure 2:
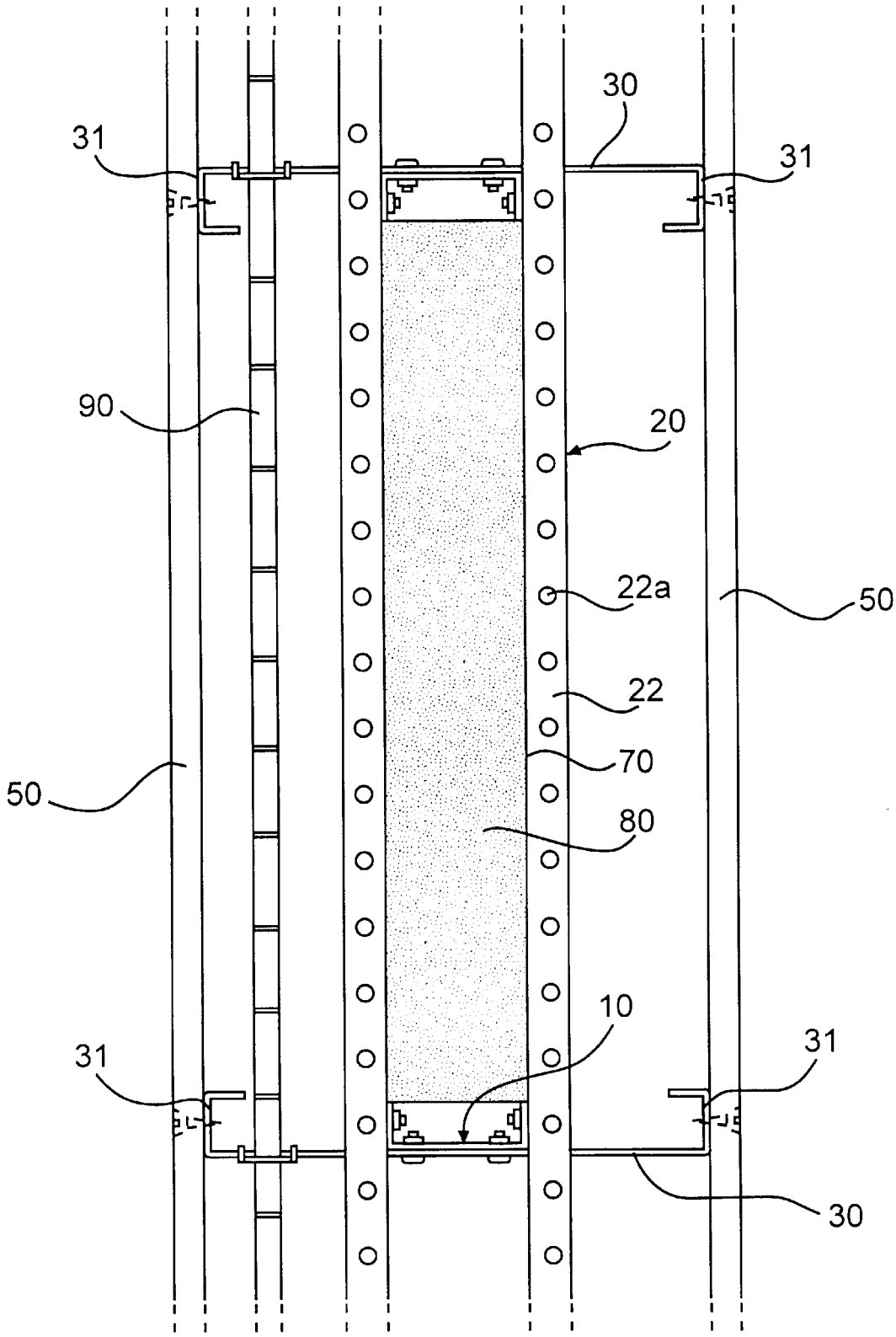
FIG. 2 is a plan view illustrating the molding process for simultaneously performing construction of insulation boards and interior/exterior materials by using a steel-frame structure according to the preferred embodiment of the present invention.

As shown in FIG. 2, The insulation board 80 is inserted in the insertion groove 70 of the steel-frame structure formed as shown in FIG. 1 and interior/exterior plates 50 are fixed on both bended portions 31 of the bracket 30 by driving a well-known drill screw.

Figure 3:
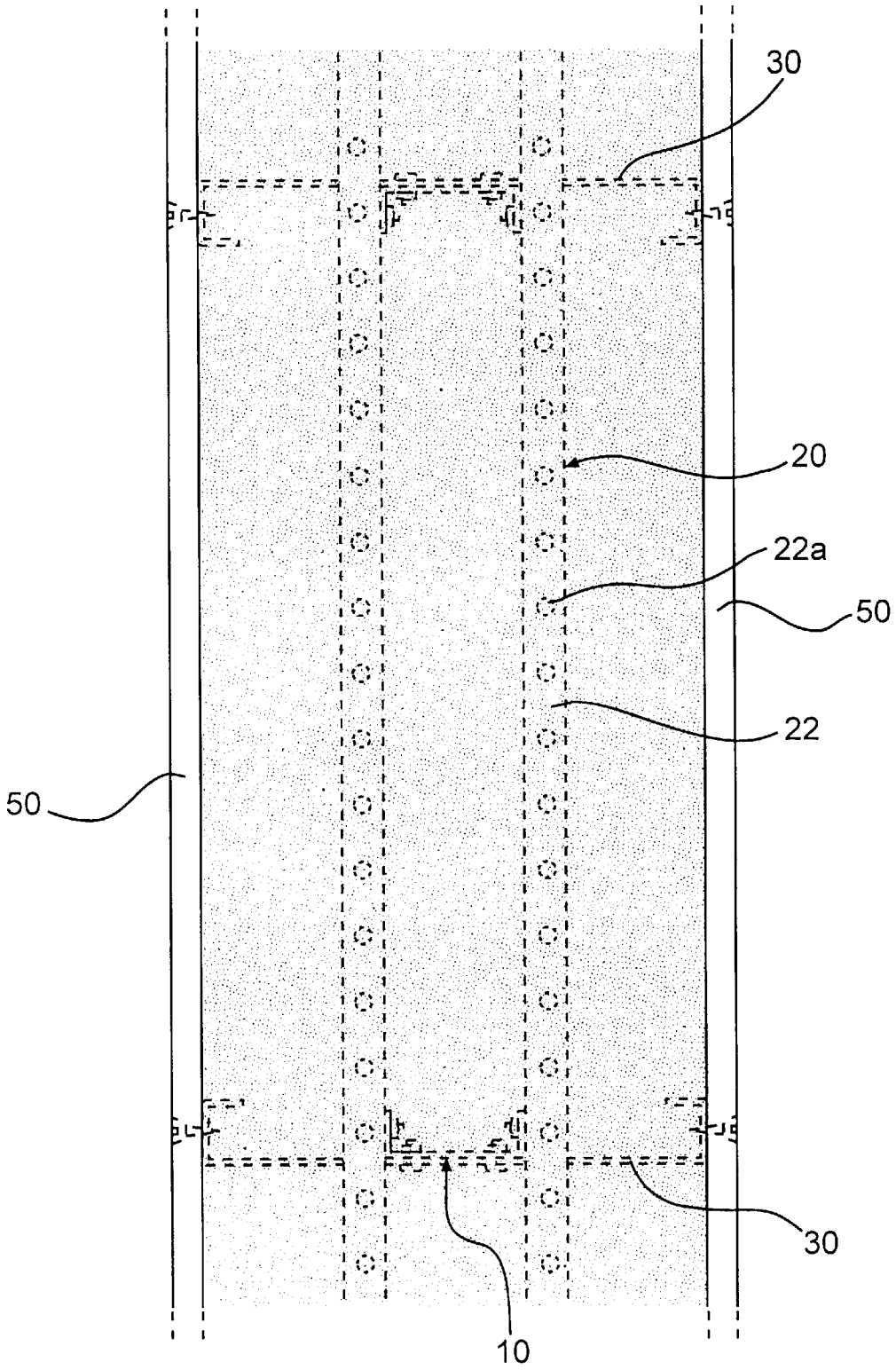
FIG. 3 is a plan view illustrating the molding process for pouring concrete into the structure of FIG. 2.

As shown in FIG. 3, fresh concrete is poured in a space formed by fixing the interior/exterior materials 50 served as molding plates. The interior/exterior materials 50 are kept at the predetermined intervals from the horizontal member 20, since the end parts of the bracket 30 are more protruded than the horizontal member 20. Therefore, when the fresh concrete is poured, it is to prevent the sides 22 of the horizontal member 20 from being exposed out the concrete wall to be cured, so that the fresh concrete is smoothly inserted between the interior/exterior materials 50 and the horizontal members 20 in order to improve the adhesive power of the interior/exterior materials 50.

To perform the insulation construction of the outer wall, the insulation board 80 is inserted in the insertion groove 70 formed between two vertical members 10 and fresh concrete is poured in the groove 70.

When the poured concrete is cured to form a wall body, the interior/exterior materials 50 fixed to the bended portions 31 of the bracket 30 may be kept being fixed very solidly on both sides of the wall body including the insulation board 80.

When the insulation construction does not need, only the interior/exterior materials 50 without the insulation board 80 are fixed on the surfaces 31 of the bracket 30 by screws and fresh concrete is poured.

The reinforcing rods 90 are fixed on the brackets 30 by using steel wire 91 through the steel wire insertion holes 30*b* of the brackets 30 and fresh concrete is poured. In the manner as above, the reinforcing rods 90 are kept on the brackets 30, thus improving arrangement maintaining power.

The sectional steel-frame structure and method of construction by using the same have advantages that the construction period and labor cost may be reduced since the construction method does not need an installation work and a dismantlement work of the molding plates, struts and interval keeping means.

Figure 4:
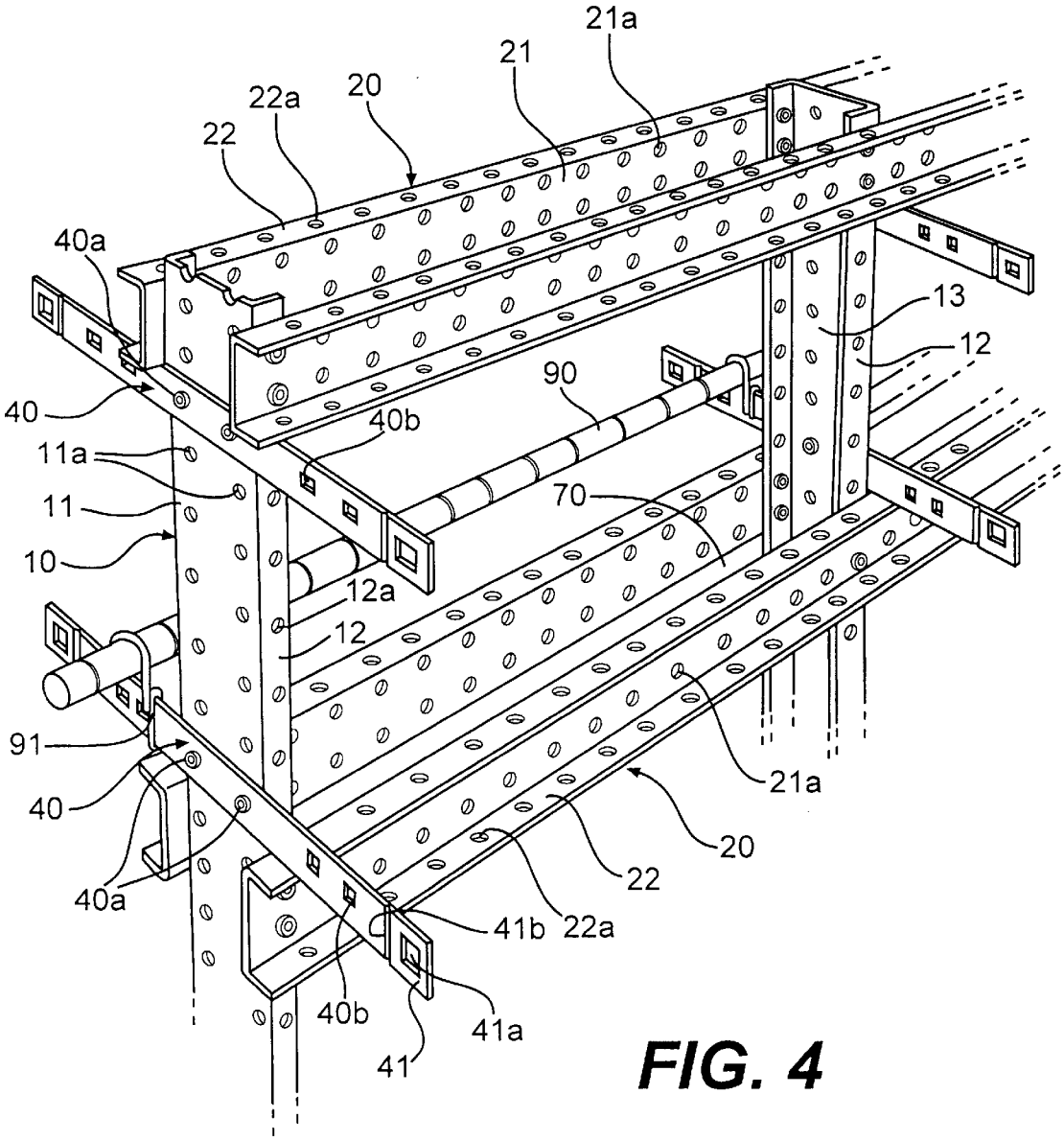
FIG. 4 is a perspective view showing a sectional steel-frame structure according to another preferred embodiment of the present invention.
Figure 5:
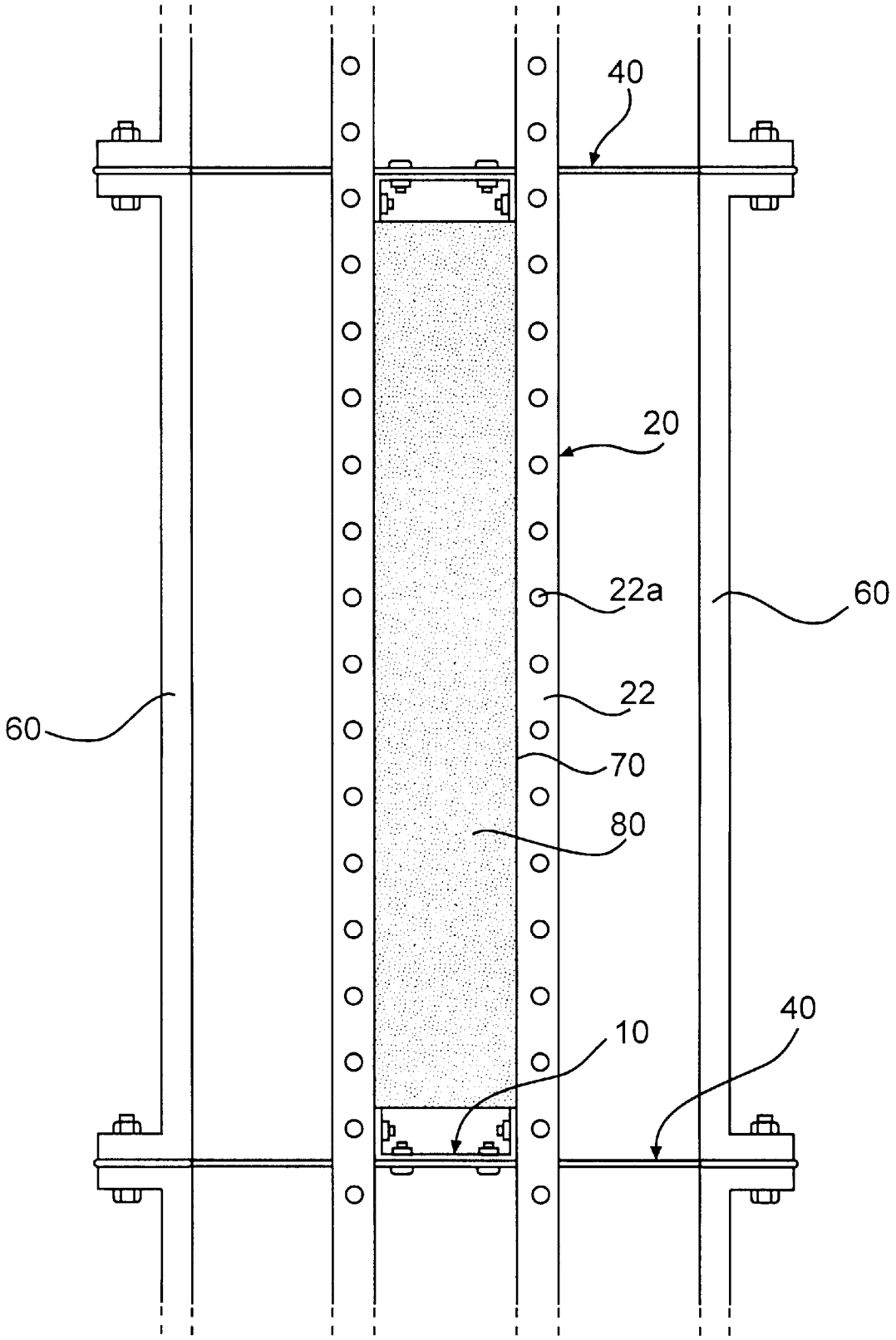
FIG. 5 is a plan view illustrating the process for performing insulation construction work and concrete pouring work by using a steel-frame structure according to the preferred embodiment of the present invention.

In FIG. 4, the sectional steel-frame structure according to the present invention has brackets 40 instead of the brackets 30 as the prescribed above.

Regarding the components except the brackets 40, like parts have been accorded like numerals and explanation thereof is not repeated.

The brackets 40 have two cutting plates 41 which may be cut by two cutting grooves 41*b* of both end parts thereof, a pair of holes 40*a* in the center of the brackets 40 to fix on the vertical members 10, and a pair of steel wire insertion holes 40*b* between the holes 40*a* and the cutting plates 41 to fix reinforcing rods 90 by steel wires 91 through the steel wire insertion holes 40*b*. Holes 41*a* are formed on surfaces of both cutting plates 41 to fix molds 60.

As shown in FIG. 4, a sectional steel-frame structure according to the present invention is formed in the manner as follows.

The vertical members 10 are oppositely set up with a certain interval to face inner surfaces thereof each other in order to make an insertion space 70 for inserting an insulation board 80.

The horizontal members 20 are assembled on upper and lower sides 12 of the vertical members 10 in the form of lattice by riveting or bolting through the holes 12*a* on the sides 12 of the vertical members 10 and the holes 21*a* on the surfaces 21 of the horizontal members 20 which are faced and coincided at regular intervals.

The brackets 40 are fixed on the vertical members 10 by riveting or bolting through the holes 40*a* of the bracket 40 and the holes 11*a* of the surfaces 11 of the vertical members 10.

A method of construction by using the sectional steel-frame structure as above will be explained in more detailed hereinafter.

In case of directly wallpapering or painting on concrete wall bodies without the interior/exterior materials, an insulation board 80 is inserted in the insertion groove 70 of the steel-frame structure formed in the manner as above.

Molding plates 60 are installed on both cutting plates 41 of the bracket 40 to coincide the inside of the molding plates 60 with the cutting grooves 41*b* of the bracket 40.

The holes 41*a* of the cutting plates 41 of the brackets 40 and holes of the molding plates 60 coincided each other are coupled by bolts.

Fresh concrete is poured in the space formed by fixing the molding plates 60. When the poured concrete is cured completely, the molding plates 60 are removed.

Figure 6:
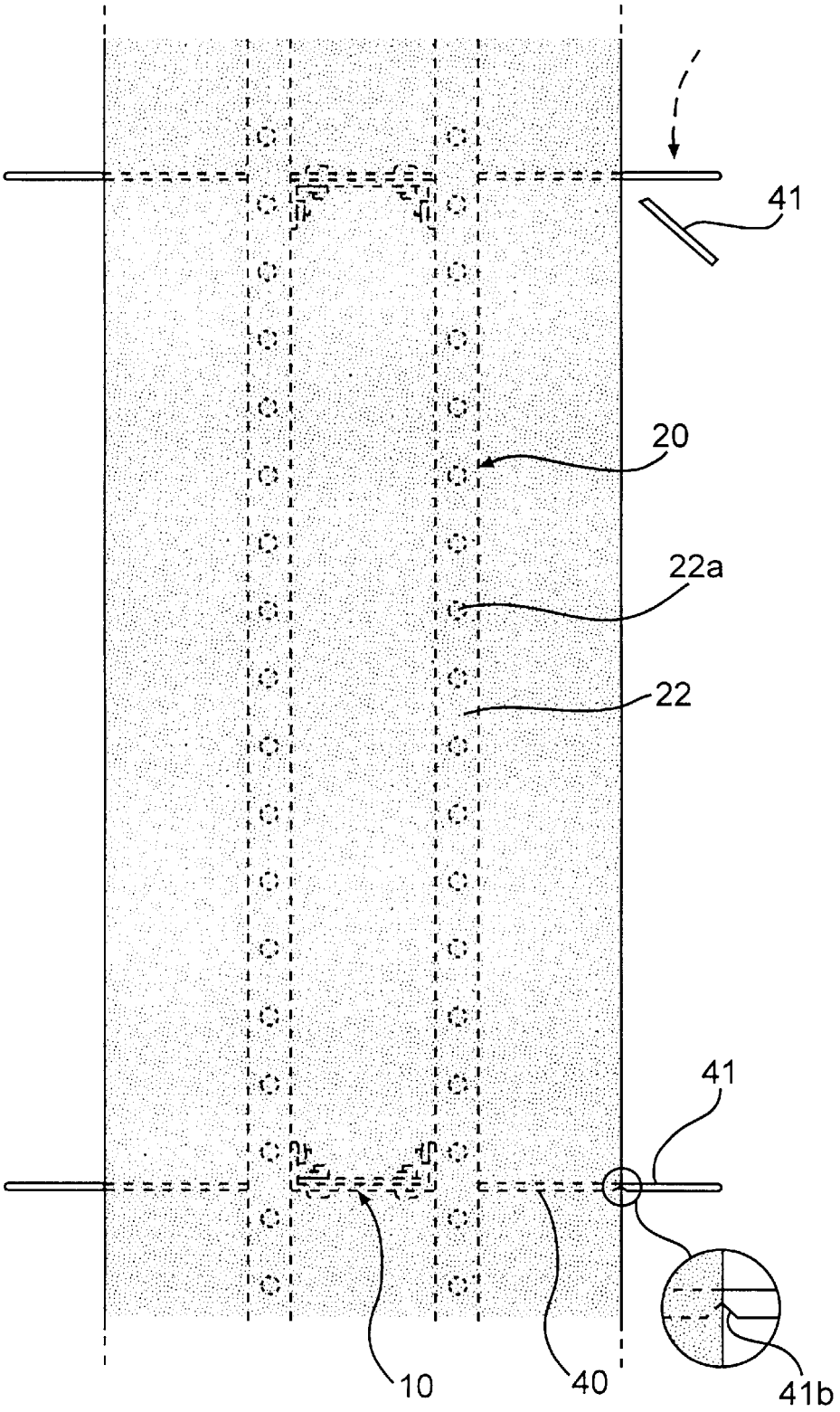
FIG. 6 is a plan view illustrating the process of cutting the plates of a bracket protruding from a concrete wall body after removing the molding plates

As shown in FIG. 6, the cutting plates 41 of the brackets 40 protrude out the cured concrete wall body after removal of the molding plates 60. As the cutting grooves 41*b* of the cutting plates 41 are coincided with the surface of the concrete wall body, the cutting plates 41 can be easily removed by hammering, so that the surface of the concrete wall body becomes smoothly and additional interior/exterior plates may be adhered easily.

When the insulation construction is not needed, only the molding plates 60 are fixed on the cutting plates 31 of the bracket 40 by bolting and fresh concrete is poured.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A mold frame for constructing a structure comprising:

an inner frame formed of opposing substantially vertical members spaced apart by opposing spacer members affixed therebetween defining a channel in a substantially vertical plane; and a plurality of brackets fixed to the inner frame and extending along at least one side thereof for supporting mold plates substantially parallel to and spaced from said one side of the inner frame and substantially parallel to the channel, wherein the vertical and spacer members have a plurality of predetermined fixing points allowing the dimensions of the channel to be defined, and each bracket includes end tab portions spaced from the inner frame fir supporting the mold plates.

2. A mold frame as claimed in claim 1 in which the end portions are connected to the brackets and severable from the brackets by a weakened portion.

3. A mold frame as claimed in claim 2 further including concrete formed about the mold frame and between the mold plates, the mold plates being removable from the concrete and the end tab of the brackets being severable.

4. A mold frame as claimed in claim 1 further comprising concrete formed between the mold plates that are permanently fixed to the end tab portions.

5. A mold frame as claimed in claim 1 further including an insulation element provided in the channel.

6. A mold frame as claimed in claim 1 in which the inner frame and brackets are formed of steel frame sections.

7. A method of constructing a concrete structure comprising forming an inner frame by fixing opposing spacer members to opposing substantially vertical members to define a channel substantially in the vertical plane, fixing brackets to the inner frame extending along at least one side of the inner frame, fixing mold plates to the brackets spaced from the inner frame and substantially parallel to the channel so as to define a mold space, and pouring concrete into the mold space.

8. A method as claimed in claim 7 further comprising the step of placing an insulation element in the channel.

9. A method as claimed in claims 7 in which the brackets include severable end pieces to which the mold plates are fixed, further comprising the steps of removing the mold plates, and severing the end pieces.

10. A structure formed by the method of claim 7.

11. A sectional steel-frame structure comprising:

vertical members having a number of holes perforated along surfaces thereof in two rows at regular intervals in a longitudinal direction and a number of holes perforated along two end parts at regular intervals in a longitudinal direction, the vertical members being formed from elongated steel sections having a bracket shape;

horizontal members having a number of holes perforated along surfaces thereof in two rows at regular intervals in a longitudinal direction and a number of holes located along two end parts at regular intervals in a longitudinal direction, the horizontal members being formed from elongated steel sections having a bracket shape; and brackets having two bent tab portions, a pair of central holes to be fixed to the vertical members, and a pair of steel wire inserting holes between the holes and the bent tab portions to fix a reinforcing rod by steel wires through the insertion holes, and holes formed on the surfaces of the bent tab portions to affix interior/exterior materials thereto, wherein pairs of the vertical members are oppositely set up with a certain interval to face inner surfaces of each other in order to define an insertion space for inserting an insulation board;

the horizontal members are assembled on upper and lower sides of the vertical members to form a lattice by riveting or bolting through the holes on the sides of the vertical members and the holes on the surfaces of the horizontal members which are aligned at regular intervals; and the brackets are fixed on the vertical members by riveting or bolting through the holes of the brackets and the holes of the surfaces of the vertical members.

12. A sectional steel-frame structure comprising:

vertical members having a number of holes perforated along surfaces thereof in two rows at regular intervals in a longitudinal direction and a number of holes perforated along two end parts at regular intervals in a longitudinal direction, the vertical members being formed from elongated steel sections having a bracket shape;

horizontal members having a number of holes perforated along surfaces thereof in two rows at regular intervals in a longitudinal direction and a number of holes located along two end parts at regular intervals in a longitudinal direction, the horizontal members being formed from elongated steel sections having a bracket shape; and brackets having two cutting plates severable at cutting grooves at both end parts thereof, a pair of central holes of the brackets to fix on the vertical members, a pair of steel wire insertion holes between the holes and the cutting plates to fix a reinforcing rod by steel wires through the steel insertion holes, and holes formed on surfaces of both cutting plates to affix molding plates, wherein pairs of the vertical members are oppositely set up with a certain interval to face inner surfaces of each other in order to define an insertion space for inserting an insulation board;

the horizontal members are assembled on upper and lower sides of the vertical members to form a lattice by riveting or bolting through the holes on the sides of the vertical members and the holes on the surfaces of the horizontal members which are aligned at regular intervals; and the brackets are fixed on the vertical members by riveting or bolting through the holes of the brackets and the holes of the surfaces of the vertical members.

13. A method of constructing using a sectional steel-frame structure according to claim 11, comprising the steps of:

assembling the sectional steel-frame structure;

inserting the insulation board in the insertion space between the vertical members;

affixing the interior/exterior material on the bent tab portions of the bracket by driving screws to define a mold space therebetween; and pouring fresh concrete into the mold space.

14. A method of construction using a sectional steel-frame structure according to claim 12, comprising the steps of:

assembling the sectional steel-frame structure;

inserting the insulation board in the insertion space between the vertical members;

fixing the molding plates on the cutting plates of the brackets by bolting and pouring fresh concrete between the molding plates;

removing the molding plates after the poured concrete is cured; and severing the cutting plates of the bracket protruding out of a concrete wall body by removal of the molding plates.

* * * * *